United States Patent [19]

Skrtic et al.

[11] Patent Number: 4,898,275

[45] Date of Patent: Feb. 6, 1990

[54] NON NESTING COMPONENT CARRIER TAPE

[75] Inventors: Tom Skrtic, Eau Claire, Wis.; Timothy J. Juntunen, Stillwater, Minn.

[73] Assignee: Minnesota Mining and Manufacturing Company, Saint Paul, Mich.

[21] Appl. No.: 356,526

[22] Filed: May 25, 1989

[51] Int. Cl.[4] ..... B65D 73/02; B65D 85/30

[52] U.S. Cl. ..... 206/330; 206/328; 206/332; 206/390

[58] Field of Search ..... 206/330, 328, 332, 390, 206/329, 519, 820; 220/23.6, 23.8

[56] References Cited

U.S. PATENT DOCUMENTS

| | | | |
|---|---|---|---|
| 3,608,711 | 9/1971 | Wiesler et al. | 206/330 |
| 4,069,916 | 1/1978 | Fowler et al. | 206/330 |
| 4,301,921 | 11/1981 | Petuch | 206/330 |
| 4,568,416 | 2/1986 | Okui et al. | 206/330 |
| 4,633,370 | 12/1986 | Hamuro et al. | 206/330 |
| 4,708,245 | 11/1987 | Boeckmann et al. | 206/330 |
| 4,724,958 | 2/1988 | Kameko et al. | 206/330 |
| 4,760,916 | 8/1988 | Kaneko et al. | 206/390 |
| 4,805,771 | 2/1989 | Hein | 206/332 |

*Primary Examiner*—Stephen Marcus

*Assistant Examiner*—Jacob Ackun, Jr.

*Attorney, Agent, or Firm*—Donald M. Sell; Walter N. Kirn; William L. Huebsch

[57] ABSTRACT

A unitary flexible carrier tape comprising a strip like portion defining a top surface for the tape, and wall portions defining a multiplicity of similarly shaped pockets spaced along the tape and opening through the top surface. Side wall portions extending between the strip like portion and bottom wall portions to define the pockets include a majority of angled parts disposed at included angles of slightly greater than a right angle with respect to the top surface of the strip like portion so that the angled parts of the side wall portions converge toward the bottom wall portions defining the pockets, and a minority of generally normal parts extending between the strip like portion and the bottom wall portions that are disposed at included angles significantly closer to a right angle with respect to the top surface of the strip like portion than the included angles between the top surface of the strip like portion and the adjacent angled parts to provide, with projecting parts of the bottom wall portions adjacent the generally normal parts, anti nesting shoulders for restricting entry of the side wall portions defining the pockets in one wrap of the carrier tape on a reel into the pockets in the wrap of carrier tape beneath it.

12 Claims, 2 Drawing Sheets

NON NESTING COMPONENT CARRIER TAPE

TECHNICAL FIELD

The present invention relates to surface mount supplies carrier tape of the type used to transport components from a component manufacturer to a different manufacturer that assembles the components into new products.

BACKGROUND ART

Surface mount supplies carrier tape is used to transport components (e.g., electrical components such as resistors, capacitors, or integrated circuits) from a component manufacturer to a different manufacturer that assembles the components into new products, typically by having automated assembly equipment sequentially remove components from the carrier tape and assemble them into the new products. Such carrier tape is a polymeric strip that has been formed to have wall portions defining a series of identical pockets at predetermined uniformly spaced intervals along its length, which pockets are shaped to closely receive identical components the tape is adapted to transport (e.g., which pockets could, for example, have rectangular or generally "I" or "T" shapes in the plane of the strip, and could have flat or rounded bottoms to accommodate the shape of the components), which strip normally also has through openings uniformly spaced along one side to receive a drive sprocket by which the strip can be driven and to provide indexing holes that can be used for accurately locating the pockets along the tape with respect to assembly equipment. Typically, the carrier tape is manufactured in a first manufacturing location, wound on a reel and transported to the supplier of the components it is intended to transport. The component supplier unwinds the carrier tape from the reel, fills the pockets along the carrier tape with components, adheres a removable cover strip along the carrier tape over the component filled pockets, winds the component filled carrier tape with the attached cover strip onto a reel, and sends it to the user who feeds it from the reel into the assembly equipment which removes the components.

While such carrier tape can be formed by continuous injection molding, it is more commonly formed from an initially flat polymeric heated thermoplastic strip using a tool to form the pockets (e.g., male and female die sets, or a male or a female die over which the strip is vacuum formed) that produces a slight draft or taper in the side wall portions defining the pockets so that the bottom wall portions defining the pockets, while having generally the same shape as the inlets to the pockets, are slightly smaller in area than the inlets to the pockets. Such draft both allows the carrier strip to be easily released from the tool by which the pockets are formed, and provides a self centering effect to subsequently facilitate positioning components in the pockets. Unfortunately, however, the draft in the side wall portions of the pockets also causes problems when the embossed carrier tape is wound on a reel prior to having the components inserted into the pockets. One of these problems is the tendency for the side wall portions defining the pockets in one wrap of the carrier tape on the reel to "nest" in or enter the pockets in the wrap of carrier tape beneath it, which causes the outer surfaces of the side wall portions in that one wrap to frictionally engage the inner surface of the side wall portions defining the pockets in the wrap beneath it. Such frictional engagement can be very firm because of the draft angle at which those wall portions are disposed which provides a locking taper relationship between the engaging surfaces. A large force is then required to pull apart the nesting wraps of the carrier tape, which force can deform the carrier tape so that it will not be properly handled by automated equipment by which components are loaded into it or by which components are removed from it. Another one of these problems is the tendency for the side wall portions defining the pockets along one side of one wrap of the carrier tape on the reel to enter the pockets in the wrap of carrier tape beneath it while the side wall portions along the other side of that wrap are supported along the uppermost surface of the carrier tape. Under these conditions, pressure from outer wraps of the strip material in the reel can cause plastic deformation of the strip so that it is no longer straight when it is unwound from the reel and will not be properly handled by automated equipment by which components are loaded into it or by which components are removed from it.

DISCLOSURE OF INVENTION

The present invention provides a surface mount supplies carrier tape of the type described above that is used to transport components from a component supplier to a user that assembles the components into new products, which carrier tape, when wound on a reel, restricts the tendency for side wall portions defining the pockets in one wrap of the carrier tape on the reel to partially or fully "nest" in or enter the pockets in the wrap of carrier tape beneath it, thereby restricting frictional engagement between the outer surfaces of the side wall portions in that one wrap with the inner surface of the wall portions defining the pockets in the wrap beneath it and resultant deformation of the carrier tape by forces unwinding it from the reel or plastic deformation of the strip on the reel as described above, and facilitating proper functioning of the carrier tape in automated equipment which load components into it or remove components from it.

According to the present invention there is provided a unitary flexible carrier tape comprising a strip like portion defining a top surface for the tape, and wall portions defining a multiplicity of similarly shaped pockets spaced along the tape and opening through the top surface, the wall portions comprising bottom wall portions, and side wall portions extending between the strip like portion and the bottom wall portions. The side wall portions include (1) a majority of angled parts disposed at included angles of slightly greater than a right angle with respect to the top surface of the strip like portion (i.e., in the range of about 93 to 98 degrees and typically 95 or 98 degrees) so that the angled parts of the side wall portions converge toward the bottom wall portions, and (2) a minority of generally normal parts extending between the strip like portion and the bottom wall portions. The generally normal anti nesting parts are disposed at included angles significantly closer to a right angle with respect to the top surface of the strip like portion (i.e., in the range of 89 to 91 degrees and preferably about 90 degrees) than the included angles between the adjacent angled parts and the top surface of the strip like portion to provide, with projecting parts of the bottom wall portions adjacent the generally normal parts, anti nesting shoulders for restricting entry of the wall portions defining the pockets in one wrap of the carrier tape on a reel into the pockets in the wrap of carrier tape beneath it.

The anti nesting shoulders preferably are generally in the shape of a portion of a cylinder having an axis generally perpendicular to the top surface of the strip portion and having a cross sections in the shapes of parts of circles in planes parallel to the strip like portion; however, alternatively they could be in the shape of a portion of a column having an axis generally perpendicular to the top surface of the strip portion and having cross sections in the shape of parts of a rectangle, triangle, octagon or any other polygon in planes parallel to the strip like portion.

The angled parts of the side walls that form the anti nesting shoulders should not form over fifty percent of the side walls along any one side of any one of the pockets, and preferably should not form over about 30 percent of the side walls along any one side of any one of the pockets so that the addition of the anti nesting shoulders on the pockets tape does not significantly complicate the manufacture of the carrier tape by causing the tape to stick in the mold or molds by which it is formed, and so that the anti nesting shoulders will not interfere with the ability of the pockets to retain components in a desired orientation. In some instances, the presence of the anti nesting shoulders on the pockets may provide a space for a projecting part of a component such as a lead and thus facilitate receiving and positioning the component in the pocket.

BRIEF DESCRIPTION OF DRAWING

The present invention will be further described with reference to the accompanying drawing wherein like reference numerals refer to like parts in the several views, and wherein:

FIG. 4 is a fragmentary side view of the carrier tape shown in FIG. 5.

DETAILED DESCRIPTION

Figure 1:
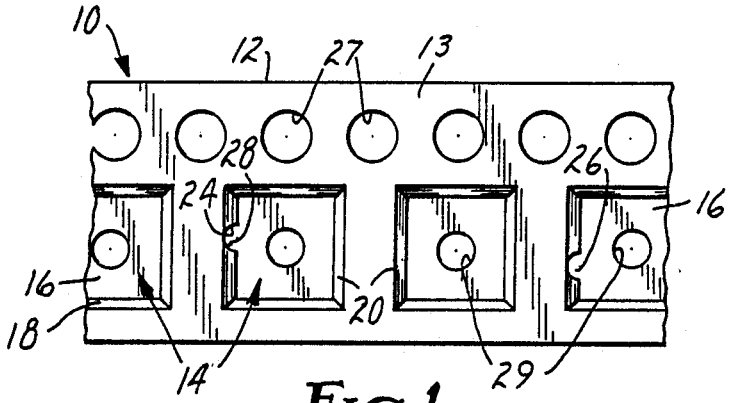
FIG. 1 is a fragmentary top view of a first embodiment of a surface mount supplies carrier tape according to the present invention.
Figure 2:
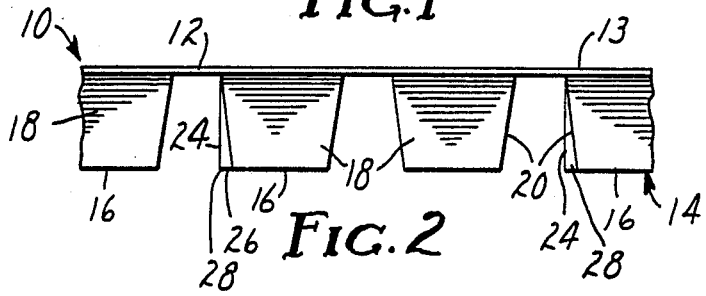
FIG. 2 is a fragmentary side view of the carrier tape shown in FIG. 1.

Referring now to FIGS. 1 through 4 of the drawing, there is shown a surface mount supplies carrier tape according to the present invention generally designated by the reference numeral 10.

Generally the carrier tape 10 is unitary, and is made of a thin polymeric material (e.g., any thermoplastic crystalline or non crystalline material such as polyester, polycarbonate, polypropylene, styrene, butadiene, ABS plastic, etc. in the range of about 0.012 to 0.04 centimeter thick, and typically 0.025 centimeter thick) so that it is flexible. The carrier tape 10 comprises a strip like portion 12 defining a top surface 13 for the tape 10, and wall portions defining a multiplicity of similarly shaped pockets 14 spaced along the carrier tape 10 and opening through the top surface 13. The wall portions comprise bottom wall portions 16, and side wall portions 18 extending between the strip like portion 12 and the bottom wall portions 16. The side wall portions 18 include a majority of angled parts 20 disposed at included angles of slightly greater than a right angle with respect to the top surface 13 of the strip like portion 12 (e.g., 95 or 98 degrees) so that the angled parts 20 of the side wall portions 18 converge toward the bottom wall portions 16; and a minority of generally normal parts 24 extending between the strip like portion 12 and the bottom wall portions 16. The generally normal parts 24 are disposed at included angles significantly closer to a right angle with respect to the top surface 13 of the strip like portion 12 (e.g., 89 to 91 degrees) than the included angles between the top surface 13 and the adjacent angled parts 20 to provide, with projecting parts 26 of the bottom wall portions 16 adjacent the generally normal parts 24, anti nesting shoulders 28 for restricting entry of the side wall portions 18 defining the pockets 14 in one wrap of the carrier tape 10 on a reel into the pockets 14 in a wrap of carrier tape 10 beneath it (see FIGS. 3 and 4). The anti nesting shoulders 28 are generally in the shape of a portion of a cylinder having an axis generally perpendicular to the top surface 13 of the strip like portion 12 and having cross sections having the shapes of parts of circles in planes parallel to the strip like portion 12. The outer edges of the anti nesting shoulders 28 can be generally aligned with the outer edges of the angled parts 20 of the side wall portions 18 at the strip like portion 12 as illustrated, or alternatively, the outer edges of the anti nesting shoulders 28 can project past the outer edges of the angled parts 20.

Every other successive pocket 14 along the carrier tape 10 has one of the nesting shoulders 28, the anti nesting shoulders 28 on successive pockets 14 along the carrier tape 10 that have anti nesting shoulders 28 are located adjacent opposite sides of the tape 10, and every set of four successive pockets 14 along the carrier tape 10 includes a pocket 14 having an anti nesting shoulder 28 adjacent one side of the tape 10, a pocket 14 having an anti nesting shoulder 28 adjacent the side of the tape 30 opposite said one side, and a pocket 14 without an anti nesting shoulder 28.

The generally normal parts 24 of the side wall portions 18 that form the anti nesting shoulders 28 form only about 30 percent of the side wall portion 18 along only one side of the pockets 14 on which they are located so that the addition of the anti nesting shoulders 28 on the pockets 14 does not significantly complicate the manufacture of the carrier tape or significantly interfere with the ability of the pockets 14 to retain components in a desired orientation.

The carrier tape 10 also has a conventional series of equally spaced and sized through openings 27 along one edge of the strip like portion 12 which will receive the teeth of a drive sprocket by which the carrier tape 10 may be driven through automated equipment which loads components into the pockets 14 or removes components from them. Also, the carrier tape 10 has an opening 29 generally centered in the bottom wall 16 of each of the pockets 14 as is required by an industry standard to allow the presence of a component in a pocket 14 to be sensed, or to allow access for a probe that facilitates removal of a component from the pocket 14.

Figure 5:
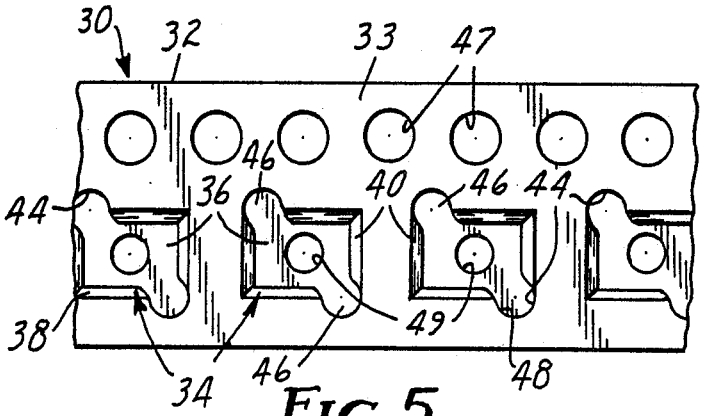
FIG. 5 is a fragmentary top view of a second embodiment of a surface mount supplies carrier tape according to the present invention.
Figure 6:
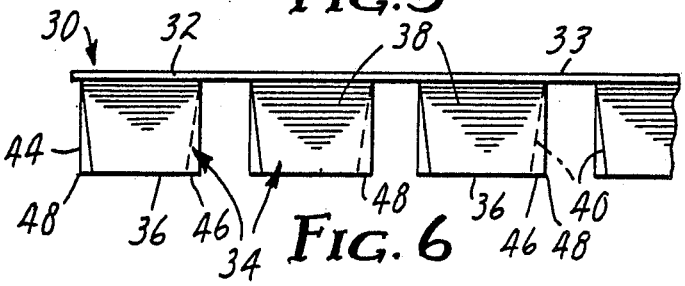

Referring now to FIGS. 5 and 6 of the drawing, there is shown a surface mount supplies carrier tape according to the present invention generally designated by the reference numeral 30.

Generally, like the carrier tape 10, the carrier tape 30 is unitary, and is also made of a thin polymeric material so that it is flexible. The carrier tape 30 comprises a strip like portion 32 defining a top surface 33 for the tape 30, and wall portions defining a multiplicity of similarly shaped pockets 34 spaced along the carrier tape 30 and opening through the top surface 33. The wall portions comprise bottom wall portions 36, and side wall portions 38 extending between the strip like portion 32 and the bottom wall portions 36. The side wall portions 38 include a majority of angled parts 40 disposed at included angles of slightly greater than a right angle with respect to the top surface 33 of the strip like portion 32 (e.g., 95 or 98 degrees) so that the angled parts 40 of the side wall portions 38 converge toward the bottom wall portions 36 defining the pockets 34; and a minority of generally normal parts 44 extending between the strip like portion 32 and the bottom wall portions 36. The generally normal parts 44 are disposed at included angles significantly closer to a right angle (e.g., 89 to 91 degrees) with respect to the top surface 33 of the strip like portion 32 than the included angles between the top surface 33 and the adjacent angled parts 40 to provide, with projecting parts 46 of the bottom wall portions 36 adjacent the generally normal parts 44, anti nesting shoulders 48 for restricting entry of the side wall portions 38 defining the pockets 34 in one wrap of the carrier tape 30 on a reel into the pockets 34 in a wrap of carrier tape 30 beneath it. The anti nesting shoulders 48 are generally in the shape of a portion of a cylinder having an axis generally perpendicular to the top surface 33 of the strip like portion 32 and having cross sections having the shapes of parts of circles in planes parallel to the strip like portion 32. The outer edges of the anti nesting shoulders 48 can project slightly past the outer edges of the angled parts 40 of the side wall portions 38 as illustrated, or alternatively, the outer edges of the anti nesting shoulders 48 can be generally aligned with the outer edges of the angled parts 40 at the strip like portion 32.

Each of the pockets 34 along the carrier tape 30 has two anti nesting shoulders 48, one adjacent each side of the tape 30 and adjacent opposite corners of each pocket 34.

The generally normal parts 44 of the side wall portions 38 that form the anti nesting shoulders 48 form only about 30 percent of the side wall portion 38 along any one side of the pockets 34 on which they are located so that the addition of the anti nesting shoulders 48 on the pockets 34 does not significantly complicate the manufacture of the carrier tape 30 or interfere with the ability of the pockets 34 to retain components in a desired orientation.

The carrier tape 30 also has a conventional series of equally spaced and sized through openings 47 along one edge of the strip like portion 12 which will receive the teeth of a drive sprocket by which the carrier tape 30 may be driven through automated equipment which loads components into the pockets 34 or removes components from them. Also, the carrier tape 30 has an opening 49 generally centered in the bottom wall 36 of each of the pockets 34 that as is required by an industry standard to allow the presence of a component in a pocket 34 to be sensed, or to allow access for a probe that facilitates removal of a component from the pocket 34.

The present invention has now been described with reference to two embodiments thereof. It will be apparent to those skilled in the art that many changes can be made in the embodiments described without departing from the scope of the present invention. Thus the scope of the present invention should not be limited to the structures described in this application, but only by structures described by the language of the claims and the equivalents of those structures.

We claim:

1. A unitary flexible carrier tape comprising a strip like portion defining a top surface for said tape, and wall portions defining a multiplicity of similarly shaped pockets spaced along said tape and opening through said top surface, said wall portions comprising:

bottom wall portions, side wall portions extending between said strip like portion and said bottom wall portions, said side wall portions including:

a majority of angled parts disposed at included angles of slightly greater than a right angle with respect to the top surface of said strip like portion so that said angled parts of said side wall portions converge toward the bottom wall portions, and a minority of generally normal parts extending between said strip like portion and said bottom wall portions, said generally normal parts being disposed at included angles significantly closer to a right angle with respect to the top surface of said strip like portion than the included angles between said adjacent angled parts and said top surface to provide, with projecting parts of said bottom wall portions adjacent said generally normal parts, anti nesting shoulders for restricting entry of said side wall portions defining the pockets in one wrap of the carrier tape on a reel into the pockets in the wrap of carrier tape beneath it.

2. A carrier tape according to claim 1 wherein successive pockets having anti nesting shoulders along said tape have the anti nesting shoulders located adjacent opposite sides of said tape.

3. A carrier tape according to claim 2 wherein every set of four successive pockets along said tape includes a pocket having an anti nesting shoulder adjacent one side of said tape, a pocket having an anti nesting shoulder adjacent the side of said tape opposite said one side, and a pocket without an anti nesting shoulder.

4. A carrier tape according to claim 1 wherein each of said pockets along said tape has two anti nesting shoulders, one adjacent each side of said tape.

5. A carrier tape according to claim 4 wherein said two anti nesting shoulders in each of said pockets are adjacent opposite corners of said pockets.

6. A carrier tape according to claim 1 wherein said generally normal parts of the side walls that form said anti nesting shoulders do not form over fifty percent of the side walls along any one side of any one of the pockets.

7. A carrier tape according to claim 1 wherein said generally normal parts of the side walls that form said anti nesting shoulders do not form over about 30 percent of the side walls along any one side of any one of the pockets.

8. A carrier tape according to claim 1 wherein said angled parts are disposed at included angles in the range of about 93 to 98 degrees with respect to the top surface of said strip like portion, and said generally normal parts are disposed at included angles in the range of about 89 to 91 degrees with respect to the top surface of said strip like portion.

9. A carrier tape according to claim 8 wherein said angled parts are disposed at included angles of about 95 degrees with respect to the top surface of said strip like portion, and said normal parts are disposed at included angles of about 90 degrees with respect to the top surface of said strip like portion.

10. A carrier tape according to claim 1 wherein said generally normal parts are disposed at included angles in the range of about 89 to 91 degrees with respect to the top surface of said strip like portion.

11. A carrier tape according to claim 1 wherein said anti nesting shoulders are generally in the shape of a portion of a cylinder having an axis perpendicular to said top surface.

12. A carrier tape according to claim 1 wherein said anti nesting shoulders preferably are generally in the shape of a portion of column having an axis perpendicular to said top surface and a cross section in the shape of a polygon.

* * * * *

UNITED STATES PATENT AND TRADEMARK OFFICE

CERTIFICATE OF CORRECTION

PATENT NO. : 4,898,275

DATED : February 6, 1990

INVENTOR(S) : Tom Skrtic and Timothy J. Juntunen

Figure 3:
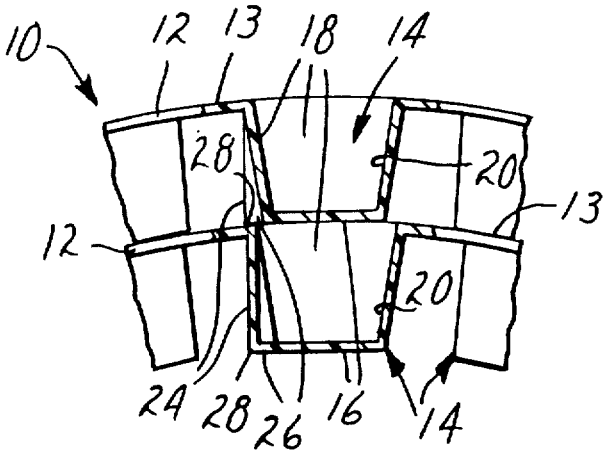
FIGS. 3 and 4 are fragmentary side views, partially in section, illustrating different possible positioning of pockets in the carrier tape of Figure above each other when the carrier tape is wound on a reel.
Figure 4:
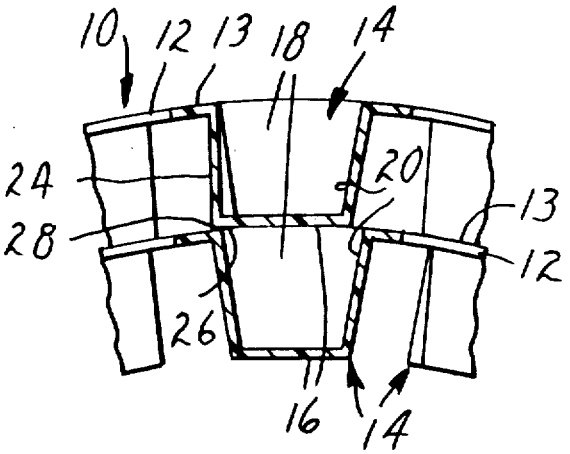

It is certified that error appears in the above-identified patent and that said Letters Patent is hereby corrected as shown below:

The Drawing Sheet, consisting of Fig. 3 and 4, should be added as shown on the attached page.

Col. 3, line 7, "having a cross sections" should be -- having cross sections --.

Col. 3, line 44, "Figure above" should be -- Figure 1 above --.

Col. 3, line 49, "Fig. 4" should be -- Fig. 6 --.

Col. 5, line 62, "pockets 34 that as is" should be -- pockets 34 that is --.

Signed and Sealed this

Eighth Day of December, 1992

*Attest:*

*Attesting Officer*

DOUGLAS B. COMER

*Acting Commissioner of Patents and Trademarks*